US009354565B2

(12) United States Patent
Sano

(10) Patent No.: US 9,354,565 B2
(45) Date of Patent: May 31, 2016

(54) PRINTER

(71) Applicant: Funai Electric Co., Ltd., Osaka (JP)

(72) Inventor: Motoaki Sano, Takatsuki (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/636,946

(22) Filed: Mar. 3, 2015

(65) Prior Publication Data

US 2015/0248085 A1 Sep. 3, 2015

(30) Foreign Application Priority Data

Mar. 3, 2014 (JP) ..... 2014-040548

(51) Int. Cl.

| | |
|---|---|
| ***G03G 15/00*** | (2006.01) |
| ***G03G 15/20*** | (2006.01) |
| ***G03G 21/20*** | (2006.01) |
| ***B41J 29/377*** | (2006.01) |

(52) U.S. Cl.

CPC ..... *G03G 15/2039* (2013.01); *B41J 29/377* (2013.01); *G03G 15/50* (2013.01); *G03G 21/20* (2013.01)

(58) Field of Classification Search

CPC ..... G03G 15/2039; G03G 15/50; G03G 15/5016; G03G 21/20

USPC ..... 399/43, 81, 91, 92, 94

See application file for complete search history.

(56) References Cited

U.S. PATENT DOCUMENTS

2013/0011150 A1* 1/2013 Lee et al. ..... 399/43

FOREIGN PATENT DOCUMENTS

JP 4821215 B2 11/2011

* cited by examiner

*Primary Examiner* — Hoang Ngo

(74) *Attorney, Agent, or Firm* — Osha Liang LLP

(57) ABSTRACT

A printer includes a printing unit that prints an image on a print medium, a sensor that measures an internal temperature, and a controller that stops printing by the printing unit based on the measured internal temperature and a predetermined temperature. The controller starts the printing based on a remaining printing volume.

15 Claims, 5 Drawing Sheets

PRINTER

TECHNICAL FIELD

The present invention relates generally to printers, and more particularly to a technique that reduces an inconvenience where printing is interrupted by cooling the printer.

BACKGROUND ART

Conventional electrographic printers use heat to fix an image formed by toner on a print medium. Conventional printers generally comprise a fixing unit that is maintained at a high temperature by a heater while printing.

When printing continuously for a long time, or a similar situation, for example, heat from the fixing unit sometimes can raise the temperature inside the printer beyond a rated temperature. In such a case, the printer interrupts printing to start cooling to lower the printer's internal temperature. When cooling starts, the internal temperature gradually lowers. Stable printing can be resumed when the printer internal temperature is below the rated temperature.

Conventionally, various techniques allow users to reduce the inconvenience of printing being interrupted by cooling.

For example, disclosed in patent reference 1 is an image-recording apparatus that execute the cooling operation (called cooing below) after ending a print job if a remaining number of pages in the job is lower than a predetermined number of pages, when it has been judged that the printer's internal temperature is higher than a predetermined temperature, while printing a job that processes a plurality of pages, interrupts the job if the remaining number of pages is higher than the predetermined number of pages, and restarts the job after cooling has been implemented.

The image-recording apparatus, by continuing to process without interruption a job having a low remaining number of pages even if a high temperature is detected while continuously processing the job, can stably print high-quality images during continuous processing thereby preventing a drop in processing performance.

PATENT REFERENCE

[Patent Reference 1] Japanese Patent Number 4821215

However, once cooling has started, the image-recording apparatus disclosed in patent reference 1 takes a long time to print results for the remainder of the job can be obtained because the remainder of the job is processed after cooling has been implemented until the temperature has adequately dropped.

SUMMARY OF THE INVENTION

A printer in accordance with one or more embodiments can reduce user inconvenience after cooling has started.

A printer according to one or more embodiments of the present invention may comprises a printing unit that prints an image on a print medium; a frame that houses the printing unit; a temperature sensor that measures a temperature inside the frame (internal temperature); an operation display that displays information for a user, and that receives an instruction from the user; and a controller that controlling the printing unit. The controller starts cooling to lower the temperature inside the frame by stopping printing at the printing unit, when a temperature that exceeds a rated temperature has been measured using the temperature sensor. When printing is restarted at the printing unit by canceling the cooling, the controller may display on the operation display a printable quantity that represents a quantity of print medium that can be printed until cooling is restarted. When a cancel instruction is received from the user via the operation display, the controller may restart printing at the printing unit by canceling the cooling.

The printer according to this constitution, for example, allows a user to view a printable quantity displayed on the operation display and issue an instruction to the printer to cancel cooling.

According to this constitution above, for example, it is possible to restart printing by canceling cooling partway through its execution, so compared to the conventional example that makes the user wait until the temperature has adequately dropped once cooling has started.

According to one or more embodiments, for example, because the printable quantity is displayed when cooling has been canceled, the user can restart printing with a shortest waiting time commensurate with a number of pages that are needed quickly from among the remaining number of pages to print, for example.

According to one or more embodiments, for example, the controller may display on the operation display as the printable quantity an amount that increases as the temperature measured by the temperature sensor lowers when displaying the printable quantity, or it can display on the operation display as the printable quantity an amount that increases as a time lengthens until the printable quantity is displayed after starting the cooling.

The printer according to the one or more embodiments above, for example, may display the printable quantity in response to either one of a temperature measured by the temperature sensor and a time until the printable quantity is displayed after starting the cooling process.

For example, the printing unit according to one or more embodiments includes an image-forming unit that forms an image on a print medium using toner, a fixing unit that fixes the image onto the print medium using heat, and a heater that heats the fixing unit; the controller can stop the heater when it starts cooling.

This constitution of one or more embodiments is suitable for executing cooling on a printer such as an electrographic printer or the like, for example, that can be caused by heat in the fixing unit overheating an inside of the frame.

Also, one or more embodiments of the present invention may be not only applied to a printer comprising a controller with such a characteristic, but also a cooling method for a printer comprising characteristic steps executed in this kind of controller. Also, one or more embodiments of the present invention may be applied to a program that causes a computer to function as the controller, and a recording medium that non-temporarily stores such a program.

The printer according to one or more embodiments of the present invention can reduce user inconvenience after cooling has started, when cooling is required to prevent overheating an inside of the frame.

DETAILED DESCRIPTION OF EMBODIMENTS

One or more embodiments of the present invention will be described below with reference to the drawings. One or more embodiments of the present invention described below are an example of one or more embodiments of the present invention. Numerical values, shapes, materials, constitutional elements, arrangement positions and connection formats of the constitutional elements, steps, and step order and others are examples. They are not intended to limit the present invention. Of the constitutional elements in the following embodiment, those constitutional elements not described in independent claims that provide the highest level description are described as random constitutional elements.

EXAMPLE

The printer according to one or more embodiments reduces user inconvenience after cooling has started, when cooling is required to prevent overheating an inside of the frame. The printer may be an electrographic printer equipped with a fixing unit as a heat source, for example.

Figure 1:
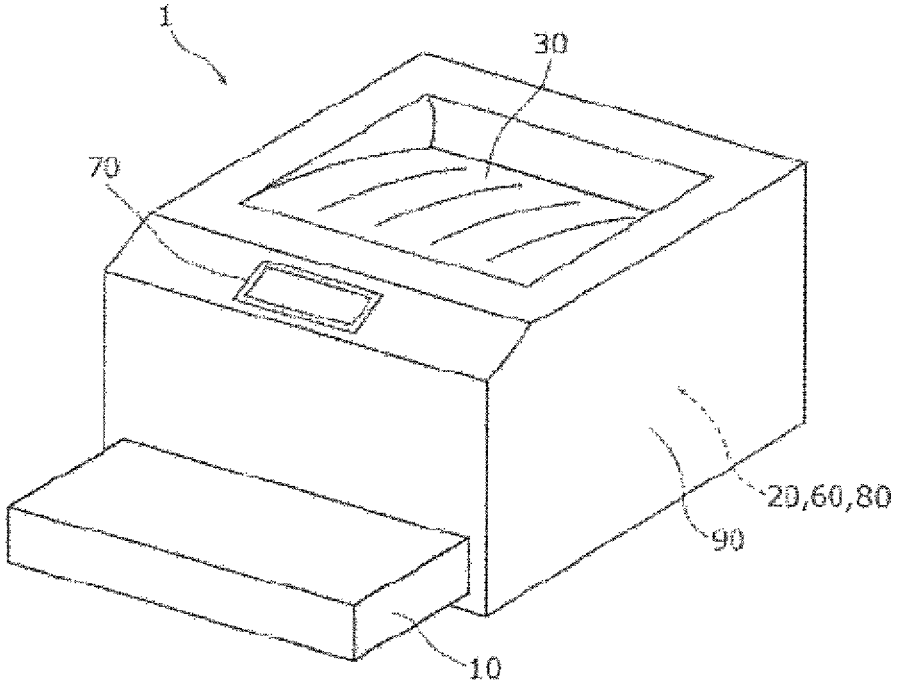
FIG. 1 shows a perspective view of an external appearance of a printer according to one or more embodiments of the present invention.

FIG. 1 shows a perspective view of an external appearance of the printer according to one or more embodiments of the present invention. The printer 1 depicted in FIG. 1 is equipped with a paper feeder 10; a paper-discharger 30; an operation display 70; and a frame 90. A printing unit 20, temperature sensor 60, and a controller 80 are housed in the frame 90.

Figure 2:
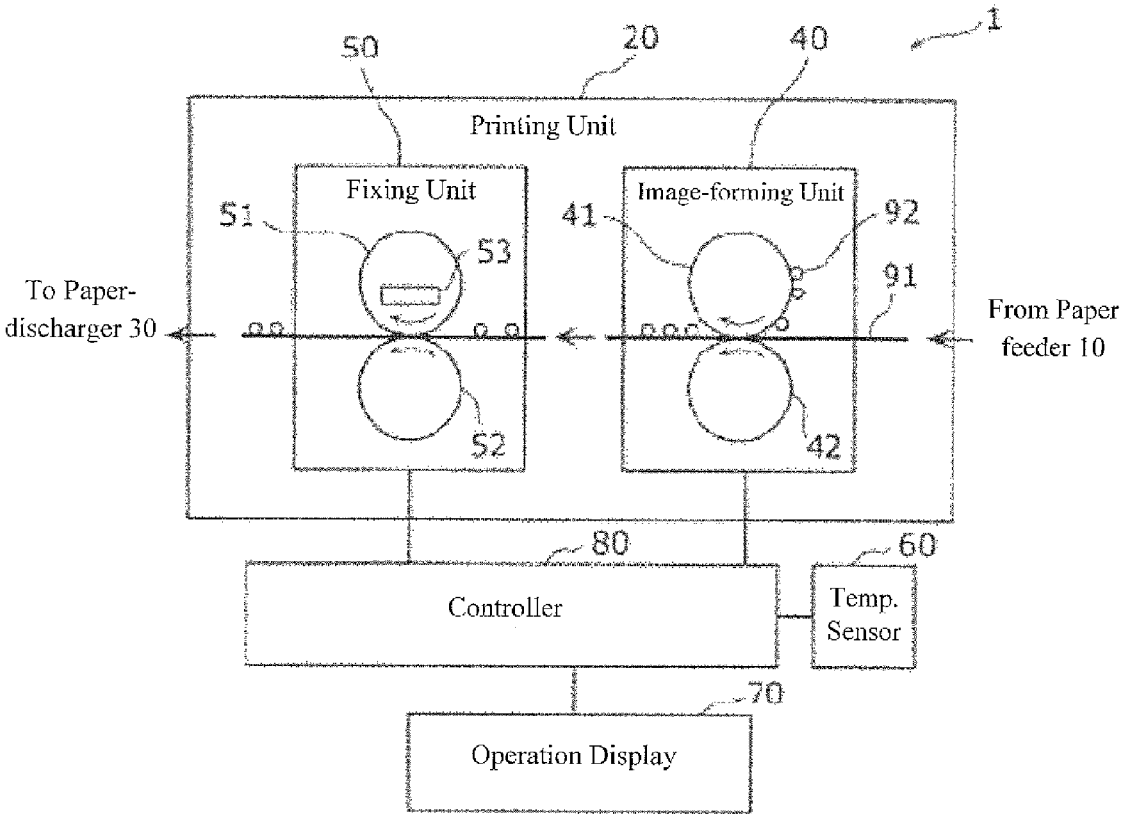
FIG. 2 shows a block diagram of a functional constitution of the printer according to one or more embodiments of the present invention.

FIG. 2 shows a block diagram of a main functional constitution of the printer 1 according to one or more embodiments of the present invention.

The printing unit 20 uses toner 92 to form any image on a print medium 91 such as paper, fed from the paper feeder 10, and feeds the paper to the paper-discharger 30. The printing unit 20 includes an image-forming unit 40 and a fixing unit 50.

The image-forming unit 40 includes a photosensitive drum 41 and a transfer roller 42, and deposits toner 92 onto a latent image formed on the photosensitive drum 41 using a light-source (not shown in the drawing), then transfers to the print medium 91 the toner 92 deposited onto the photosensitive drum 41.

A fixing unit 50 includes a heat roller 51 and a pressure roller 52 to fix onto the print medium 91 the toner 92 transferred to the print medium 91 using heat and pressure. The heat roller 51 is heated by a heater 53. The heater 53 can be composed of a halogen heater.

The temperature sensor 60 measures an internal temperature of the frame 90 and outputs a signal indicating the measurement result. The temperature sensor 60 may be a thermistor, for example.

The operation display 70 displays information for the user, and receives instructions from the user. The operation display 70 may be a liquid-crystal touch-panel for example.

The controller 80 implements all controls of the printer 1 including control of the printing unit 20. The controller 80, for example, may be hardware circuits that include a processor and a memory. The processor can control the printer 1 by executing a program recorded in the memory.

Next, an operation of the printer 1 constituted as described above will be described.

Figure 3:
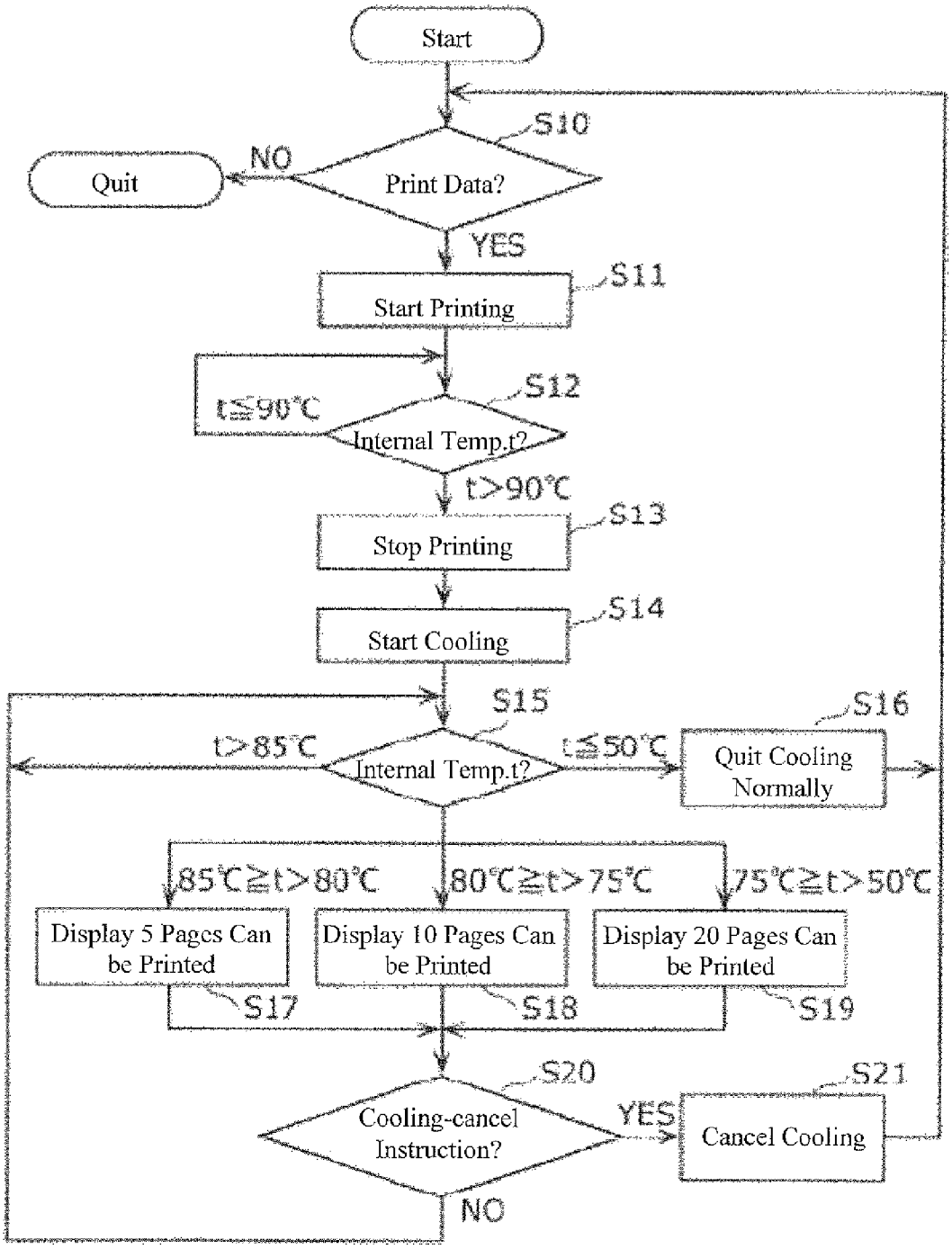
FIG. 3 shows a flowchart of an operation of the printer according to one or more embodiments of the present invention.

FIG. 3 shows a flowchart of the operation of the printer according to one or more embodiments of the present invention. This printing process is a process for printing to a print medium an image (including characters and graphics) represented by image data supplied to the printer. This includes a characteristic cooling control. A detailed explanation will be described below with reference to the flowchart in FIG. 3.

Printing is started (S11) if there is print data (Yes at S10).

The controller 80 references output of the temperature sensor 60; if an internal temperature t of the frame 90 represented by the output exceeds a rated temperature (90° C. as an example) (t>90° C. at S12), it stops printing (S13) and starts cooling (or cooling process) (S14) to lower the internal temperature of the frame 90.

Specific content of cooling is not particularly limited, but as an example, the controller 80 can stop the heater 53 in the fixing unit 50 when starting cooling. Also, if the printer 1 comprises a fan for cooling (not shown in the drawing), the controller 80 can either start the fan, or raise the speed higher than a speed when the printer is operating normally.

When cooling starts, the internal temperature of the frame 90 gradually lowers.

After starting cooling, the controller 80 references output of the temperature sensor 60; if the internal temperature t of the frame 90 represented by the output has fallen below a cooling-quit temperature (50° C. as an example) (t≤50° C. at S15), it quits cooling normally (S16). Also, if there is remaining print data, it restarts printing (S10, S11). After quitting cooling normally, the controller 80 can re-operate the heater 53 in the fixing unit 50 to restart printing.

Such restarting and normally quitting cooling are processes that are conventionally executed. The user having to wait a comparatively long time of several minutes until cooling quits normally is a problem.

Therefore, a characteristic cooling control that can restart printing by interrupting the cooling that is being executed is introduced to the printer 1 according to one or more embodiments. In other words, to restart printing at the printing unit 20 by interrupting the cooling that is being executed, display on the operation display 70 a printable quantity that indicates a quantity of the print medium 91 that can be printed until cooling is restarted. Also, when a cancel instruction (an instruction to interrupt the cooling) is received from the user via the operation display 70, restart printing at the printing unit 20 by canceling the cooling that is executed. After cancelling cooling, the controller 80 can re-operate the heater 53 in the fixing unit 50 to restart printing.

To implement such cooling control, the controller 80 references output of the temperature sensor 60 after starting cooling; the lower that the internal temperature t of the frame 90 represented by the output, the greater the quantity that is displayed on the operation display 70 (S15, S17, S18, S19) as a printable quantity. The printable quantity may be represented as a number of pages of the print medium.

The controller 80 stores in advance a printable quantity that corresponds to each of a plurality of ranges of internal temperatures t of the stored printable quantities, the controller 80 may display a printable quantity that corresponds to a range in which the internal temperature t of the frame 90 belongs, represented by a periodic output of the temperature sensor 60.

Specific numerical values for the number of internal temperature t ranges, upper and lower limits of each range, and the displayed printable quantity are not particularly limited.

However, as an example for the description, as shown in FIG. 3, when 85° C.≥t>80° C., display five pages can be printed; when 80° C.≥t>75° C., display 10 pages may be printed; and when 75° C.≥t>50° C., display 20 pages may be printed.

Figure 4:
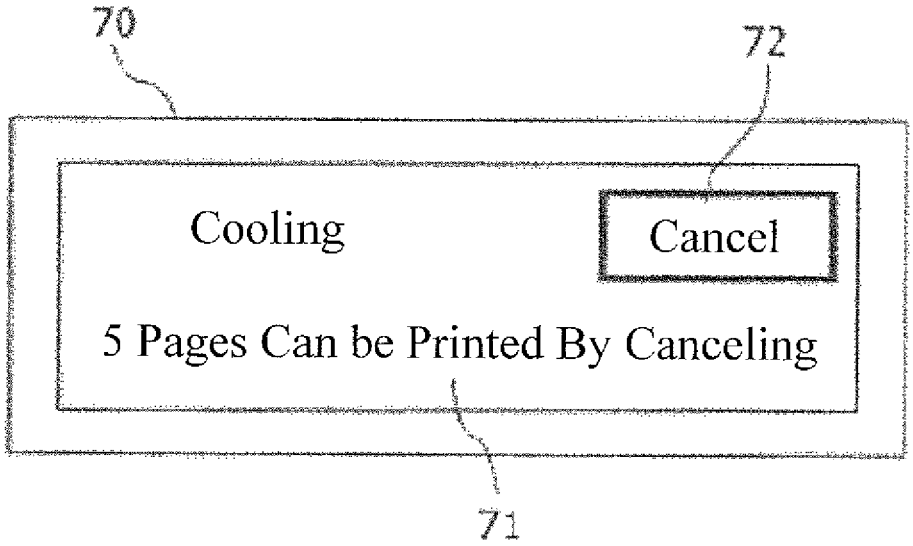
FIG. 4 shows a view of an operation display of the printer according to one or more embodiments of the present invention.

FIG. 4 shows a view of a printable quantity displayed on the operation display 70 according to one or more embodiments of the example of the present invention. In the example depicted in FIG. 4, characters that indicated that the printer is cooling; a printable quantity 71 (5 pages in the example depicted in FIG. 4) and a cancel icon 72 are displayed on the operation display 70. The example display in FIG. 4 corresponds to a display at Step S17 in FIG. 3.

After starting cooling, the controller 80 can display the printable quantity that corresponds to the periodic internal temperature t of the frame 90 at predetermined time intervals, each time the internal temperature t changes (drops) a predetermined amount.

If the printable quantity is extremely low when cooling was cancelled while it was being executed (for example, five pages or less), the controller 80 may not display the printable quantity (t>85° C. at S15). At such a time, only characters indicating that the printer is cooling may be displayed on the operation display 70, while the printable quantity 71 and the cancel icon 72 are not displayed. By doing so, it is possible to ensure a minimum cooling period that is required for the printer 1 to operate in a stable manner.

By touching the cancel icon 72, the user can issue the cooling-cancel instruction to the printer 1.

After displaying the printable quantity 71, the controller 80 cancels the cooling (S21) that is being executed by receiving a touch operation (Yes at S20) on the cancel icon 72 which is the cancel instruction, via the operation display 70. Also, if there is remaining print data, printing restarts (S10, S11). After cooling was cancelled, the controller 80 may operate the heater 53 in the fixing unit 50 to restart printing.

As described above, the printer 1 displays as a printable quantity 71 on the operation display 70 a quantity that increases as the internal temperature in the frame 90 decreases, according to the flowchart depicted in FIG. 3. Such a printable quantity 71 is one example of a printable quantity that represents a quantity of print medium 91 that can be printed until the cooling is restarted, when restarting printing at the printing unit 20 by canceling the cooling that is being executed.

The user can look at the printable quantity 71 displayed on the operation display 70 and issue the cancel instruction for cooling to the printer 1 by touching the cancel icon 72.

The user can complete the remaining printing without having to wait for cooling to quit normally by touching the cancel icon 72 when the printable quantity 71 is higher than the remaining number of pages to print. Also, the user can immediately take action for a print result of a number of pages needed quickly, by touching the cancel icon 72 when the printable quantity 71 is higher than the number pages that are quickly needed in the remaining number of pages to be printed.

Thus, the printer 1 according to one or more embodiments allows the user to restart printing by canceling the cooling that is being executed before it quits normally. As a result, compared to the conventional example where the user is made to wait until cooling quits normally once it has started, the cooling waiting time is shorter. Also, because the printable quantity is displayed when cooling that is being executed has been canceled, the user can restart printing with the shortest waiting time commensurate with the print results for the number of pages quickly needed.

Another Example

The printer according to one or more embodiments of the present invention has been described above, but the invention is not to be construed to be limited to that working example. Various modifications that can be considered by one skilled in the art may be made without departing from the scope of the invention, and can be included in the scope of the present invention.

With the examples described above, the lower the temperature measured by the temperature sensor 61, the higher the quantity that is displayed on the operation display 70 as the printable quantity 71 when displaying the printable quantity. On the other hand, in other embodiments, the longer the time until the printable quantity 71 is displayed, the higher the quantity that is displayed on the operation display 70 as the printable quantity 71 after starting cooling.

Figure 5:
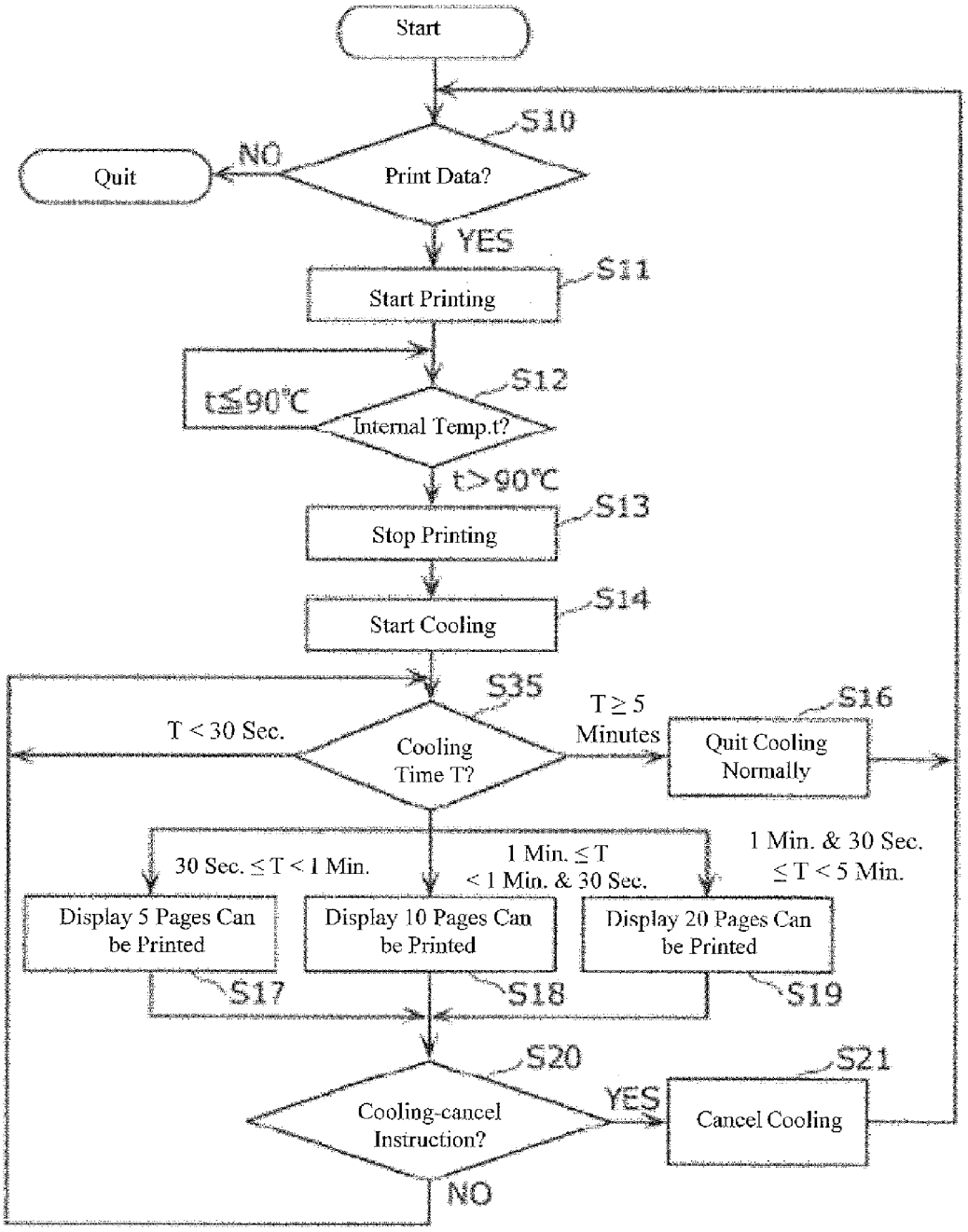
FIG. 5 shows a flowchart of an operation of a printer according to one or more embodiments of the present invention.

FIG. 5 shows a flowchart of an operation of the printer 1 according to one or more embodiments. Compared to the flowchart in FIG. 3, conditions for judging a normal end to cooling and the printable quantity at step S35 in the flowchart in FIG. 5 are changed to the following.

The controller 80 measures as a cooling time T an elapsed time after cooling is started. When the cooling time T reaches a predetermined time (for example, five minutes) (T≥five minutes at S35), the controller quits cooling normally (S16) and restarts printing using the remaining print data (S10, and S11). Also, the longer the cooling time T, the higher the quantity the controller 80 displays on the operation display 70 as the printable quantity (S35, S17, S18, S19).

The controller 80 stores in advance a printable quantity that corresponds to each of a plurality of ranges of cooling times T, for example. The controller 80 may display the printable quantity that corresponds to a range in which each cooling time T belongs, in the stored printable quantity.

Specific numerical values for the number of cooling time T ranges, upper and lower limits of each range, and the displayed printable quantity are not particularly limited. However, as an example for the description, as shown in FIG. 5, when 30 seconds≤T<one minute, display five pages can be printed; when one minute≤T<one minute and 30 seconds, display 10 pages can be printed; and when one minute and 30 seconds≤T<five minutes, display 20 pages can be printed.

As the example depicted in FIG. 4, characters that indicate that the printer is cooling; a printable quantity 71 and the cancel icon 72 are displayed on the operation display 70.

After starting cooling, the controller 80 can display the printable quantity that corresponds to the periodic cooling time T at predetermined time intervals each time the internal temperature t changes (drops) a predetermined amount.

If the printable quantity is extremely low (for example, five pages or less) when cooling was cancelled while it is being executed, the controller 80 may display the printable quantity (T<30 seconds at S35).

As described above, the printer 1 displays as a printable quantity 71 on the operation display 70 a quantity that increases as the cooling time T lengthens, according to the flowchart depicted in FIG. 5. Such a printable quantity 71 is one example of a printable quantity that represents a quantity of print medium 91 that can be printed until the cooling is restarted, when printing at the printing unit 20 is restarting by canceling the cooling that is being executed.

A same effect as one or more embodiments of the example is also attained with such the operation according to one or more embodiments of another example.

INDUSTRIAL APPLICABILITY

The present invention widely can be used on printers that require cooling to prevent overheating, such as laser printers and LED printers and other similar systems.

EXPLANATION OF REFERENCES

1 Printer
10 Paper feeder
20 Printing unit
30 Paper-discharger
40 Image-forming unit
41 Photosensitive drum
42 Transfer roller
50 Fixing unit
51 Heat roller
52 Pressure roller
53 Heater
60 Controller
61 Temperature sensor
70 Operation display
80 Controller
90 Frame
91 Print medium
92 Toner

What is claimed is:

1. A printer comprising:
a printing unit that prints an image on a print medium;
a sensor that measures an internal temperature; and
a controller that stops printing by the printing unit based on the measured internal temperature and a predetermined temperature, wherein
the controller starts the printing based on a remaining printing volume that differs based on a predetermined condition.

2. The printer according to claim 1, wherein the remaining printing volume differs based on the internal temperature measured while the printing is stopped.

3. The printer according to claim 2, wherein the remaining printing volume differs for each of predetermined of ranges of temperatures.

4. The printer according to claim 2, wherein the remaining printing volume becomes larger as the internal temperature measured while the printing is stopped becomes lower.

5. The printer according to claim 1, further comprising an operation display that displays the remaining printing volume and receives an instruction to start the printing.

6. The printer according to claim 5, wherein the operation display does not display the remaining printing volume when the remaining printing volume is less than a predetermined value.

7. The printer according to claim 5, wherein the operation display does not receive the instruction when the remaining printing volume is larger than a remaining number of pages to be printed.

8. The printer according to claim 1, wherein the remaining printing volume differs based on a duration of the printing being stopped.

9. The printer according to claim 8, wherein the remaining printing volume differs for each of predetermined time intervals.

10. The printer according to claim 8, wherein the remaining printing volume becomes larger as the duration of the printing being stopped becomes longer.

11. The printer according to claim 1, wherein the printing unit comprises:
an image-forming unit that forms the image on the print medium using a toner;
a fixing unit that fixes the image on the print medium using heat; and
a heater that heats the fixing unit, wherein
the controller stops the heater when the controller stops printing.

12. The printer according to claim 1, wherein the internal temperature is an internal temperature of a frame of the printer.

13. The printer according to claim 12, wherein the internal temperature is a temperature of the printing unit or around the controller.

14. The printer according to claim 1, wherein the predetermined temperature is a rated temperature.

15. The printer according to claim 1, wherein the remaining printing volume is a number of printable pages after the controller starts the printing.

* * * * *